US009871309B2

(12) United States Patent
Gao et al.

(10) Patent No.: US 9,871,309 B2
(45) Date of Patent: Jan. 16, 2018

(54) CONNECTOR

(71) Applicant: Tyco Electronics (Shanghai) Co. Ltd., Shanghai (CN)

(72) Inventors: Zhigui Gao, Shanghai (CN); Chao Ye, Shanghai (CN)

(73) Assignee: Tyco Electronics (Shanghai) co. Ltd., Shanghai (CN)

( * ) Notice: Subject to any disclaimer, the term of this patent is extended or adjusted under 35 U.S.C. 154(b) by 0 days.

(21) Appl. No.: 15/209,270

(22) Filed: Jul. 13, 2016

(65) Prior Publication Data

US 2016/0322720 A1 Nov. 3, 2016

Related U.S. Application Data

(63) Continuation of application No. PCT/IB2015/050166, filed on Jan. 9, 2015.

(30) Foreign Application Priority Data

Jan. 13, 2014 (CN) ..... 2014 2 0020934 U

(51) Int. Cl.

| | |
|---|---|
| ***H01R 13/64*** | (2006.01) |
| ***H01R 11/05*** | (2006.01) |
| ***H01R 4/30*** | (2006.01) |
| ***H01R 9/18*** | (2006.01) |
| ***H01R 13/11*** | (2006.01) |
| ***H01R 13/432*** | (2006.01) |

(52) U.S. Cl.

CPC ..... *H01R 11/05* (2013.01); *H01R 4/30* (2013.01); *H01R 4/302* (2013.01); *H01R 9/18* (2013.01); *H01R 13/11* (2013.01); *H01R 13/432* (2013.01)

(58) Field of Classification Search

CPC ..... H01R 13/631; H01R 13/6315; H01R 13/112; H01R 13/187; H02G 5/08; H01H 1/42; H01H 1/54

USPC ..... 439/249, 251, 843, 844, 845

See application file for complete search history.

(56) References Cited

U.S. PATENT DOCUMENTS 4,845,589 A * 7/1989 Weidler ..... H01R 25/162 200/51 R 4,867,713 A * 9/1989 Ozu ..... H01H 1/54 439/564

(Continued)

FOREIGN PATENT DOCUMENTS

WO 2005065254 A2 12/2004

OTHER PUBLICATIONS

PCT International Search Report and Written Opinion of the International Searching Authority, dated Mar. 31, 2015, 7 pages.

*Primary Examiner* — Hien Vu

(74) *Attorney, Agent, or Firm* — Barley Snyder

(57) ABSTRACT

A connector is provided and includes a contact, a contact receiving housing, an insertion member, and a securing device. The contact includes a frame and a terminal section extending from a front end of the frame. The contact receiving housing includes a bottom wall and a pair of side walls extending from opposite sides of the bottom wall to define a contact receiving space. The insertion member extends from an end of the bottom wall and is positioned between the pair of side walls. The insertion member corresponds with an inner surface of the bottom wall. The securing device is positioned inside the contact receiving housing and secures the contact and the contact receiving housing in a fixed position.

25 Claims, 4 Drawing Sheets

(56) References Cited

U.S. PATENT DOCUMENTS

| | | | | |
|---|---|---|---|---|
| 5,431,576 | A * | 7/1995 | Matthews | H01R 13/113 439/247 |
| 7,581,972 | B2 * | 9/2009 | Daamen | H01R 13/6315 439/249 |
| 9,054,456 | B2 * | 6/2015 | Orris | H01R 13/112 |
| 9,331,409 | B2 * | 5/2016 | Naganuma | H01R 12/7047 |
| 2009/0047814 | A1 | 2/2009 | Daamen | |

* cited by examiner

CONNECTOR

CROSS-REFERENCE TO RELATED APPLICATION

This application is a continuation of PCT International Application No. PCT/IB2015/050166 filed Jan. 9, 2015, which claims priority under 35 U.S.C. §119 to Chinese Patent Application No. 2014200209347 filed on Jan. 13, 2014.

FIELD OF THE INVENTION

The present invention relates to a connector and, more particularly, to a plate-mounted power source connector.

BACKGROUND

Currently, there are various known plate-mounted power source connectors that connect a bus bar for network energy equipment, a unit base station, a server, a memorizer, a network routing device and an industrial power distribution device. However, these known plate-mounted power source connectors typically include a large number of components and occupy a large space on the mounting plate, which then complicates mounting operations and requires a large contact resistance.

SUMMARY

The present invention has been made to overcome or alleviate at least one aspect of the above mentioned disadvantages.

Accordingly, a connector is provided that can be secured to a mounting plate easily. The connector includes a contact, a contact receiving housing, an insertion member, and a securing device. The contact includes a frame and a terminal section extending from a front end of the frame. The contact receiving housing includes a bottom wall and a pair of side walls extending from opposite sides of the bottom wall to define a contact receiving space. The insertion member extends from an end of the bottom wall and is positioned between the pair of side walls. The insertion member corresponds with an inner surface of the bottom wall. The securing device is positioned inside the contact receiving housing and secures the contact and the contact receiving housing in a fixed position.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
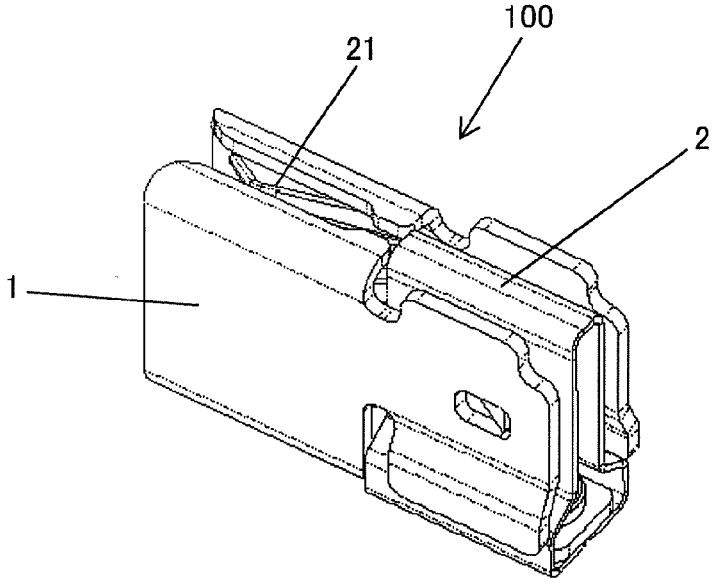
FIG. 1 is a perspective view of a connector according to the invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Now with reference to FIGS. 1-6, a connector 100 according to the invention will be described As shown in FIGS. 1-4, the connector 100 generally includes a contact receiving housing 1 and a contact 2 inserted into the contact receiving housing 1.

In the shown embodiment, the contact receiving housing 1 is u-shaped and includes a bottom wall 11 and two side walls 12 that extend upward from two opposite sides of the bottom wall 11. The bottom wall 11 and the side walls 12 define a receiving space for receiving the contact 2.

In the shown embodiment, the contact 2 is made from a conductive material. The contact 2 generally includes including a frame 20 defined by a top wall 203, a pair of side walls 202, a bottom wall 201, and a terminal section 21 that extends from the front end of the frame 20.

Figure 2:
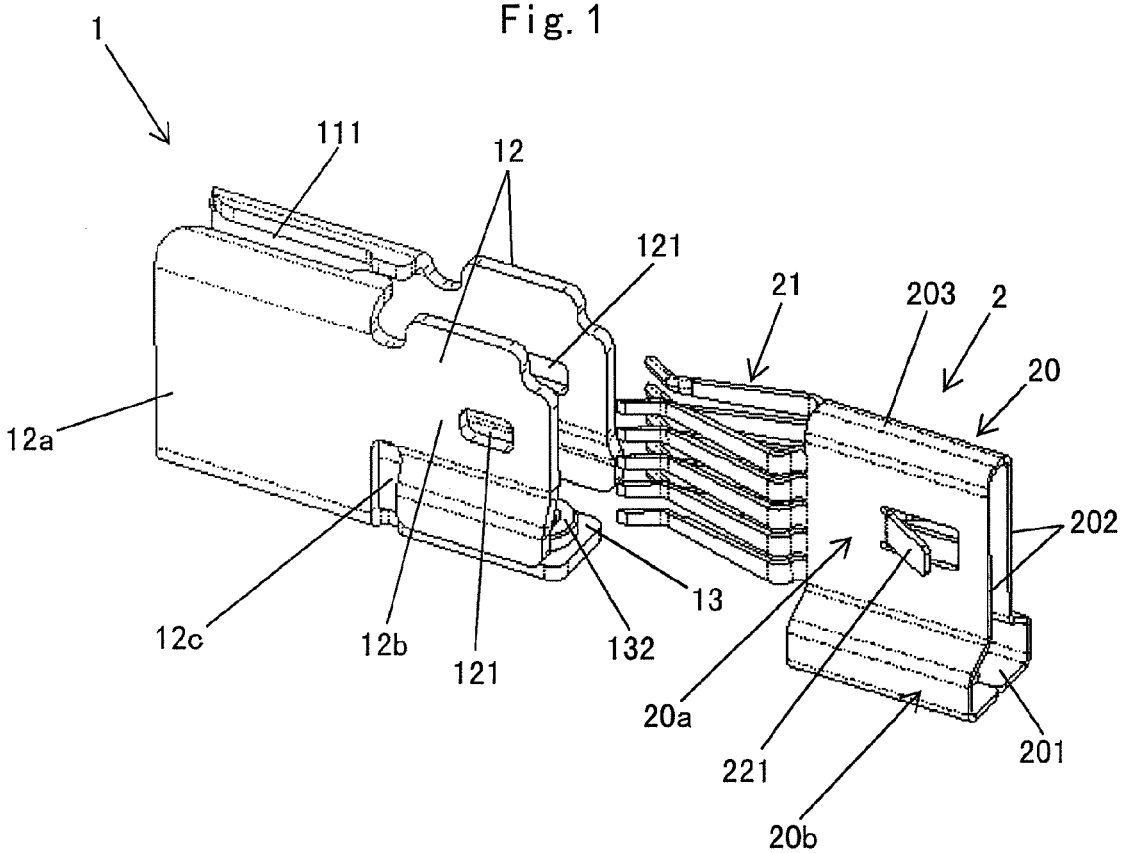
FIG. 2 is an exploded view of the connector shown in FIG. 1.
Figure 4:
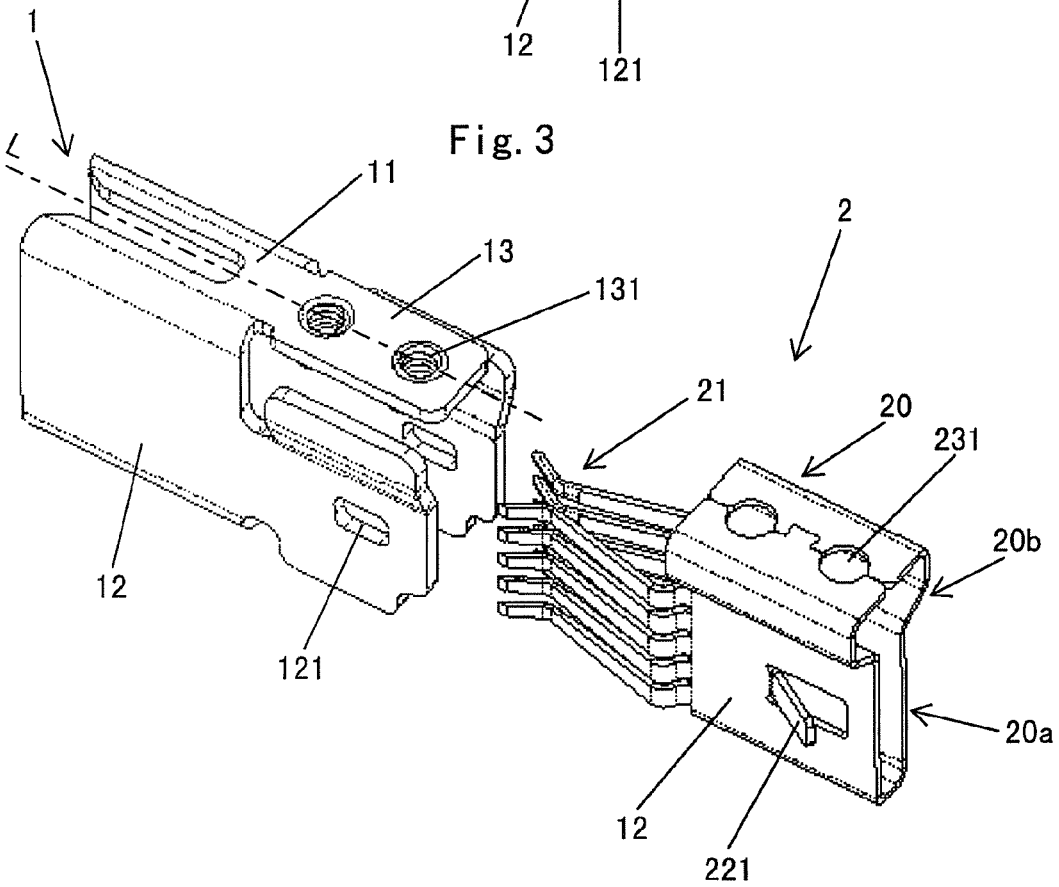
FIG. 4 is an exploded view of the connector shown in FIG. 3.

As is clearly shown in FIGS. 2 and 4, an insertion member 13 is provided and extends from one end of the bottom wall 11. The insertion member 13 is separated from and extends between the pair of side walls 12. In use, the insertion member 13 is adapted to be inserted inside the frame 20 of the contact 2 and to abut on an inner surface of the bottom wall 201 of the frame 20. In this state, the contact 2 is fitted over the insertion member 13 and positioned in the receiving space of the housing 1.

Figure 6:
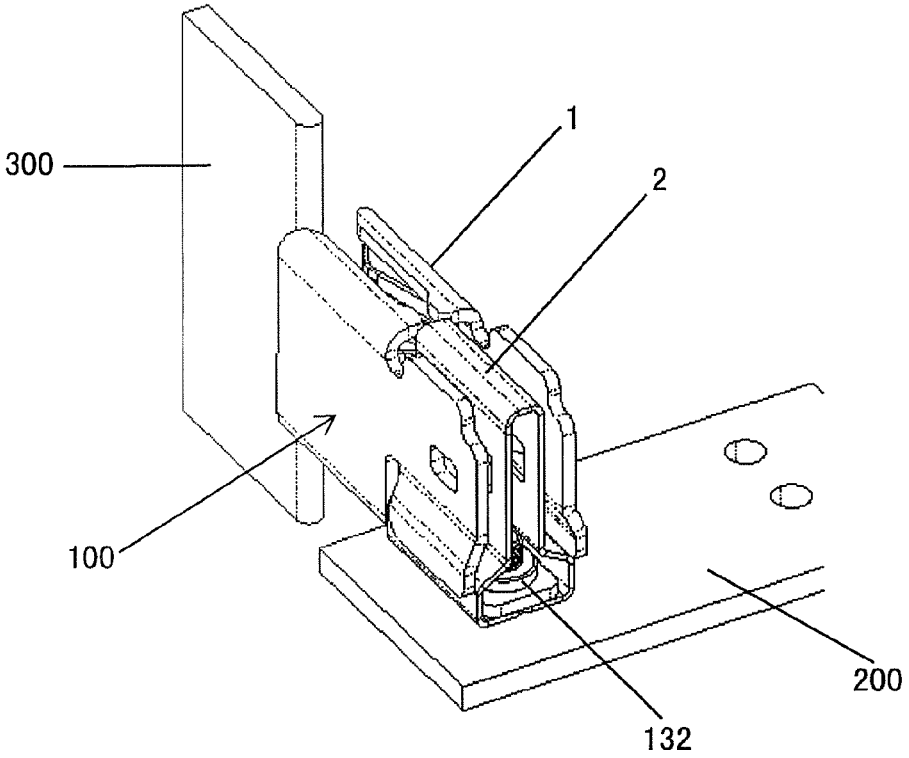
FIG. 6 is a perspective view of a connector according to the invention that is secured to a mounting plate and a bus bar.
Figure 7:
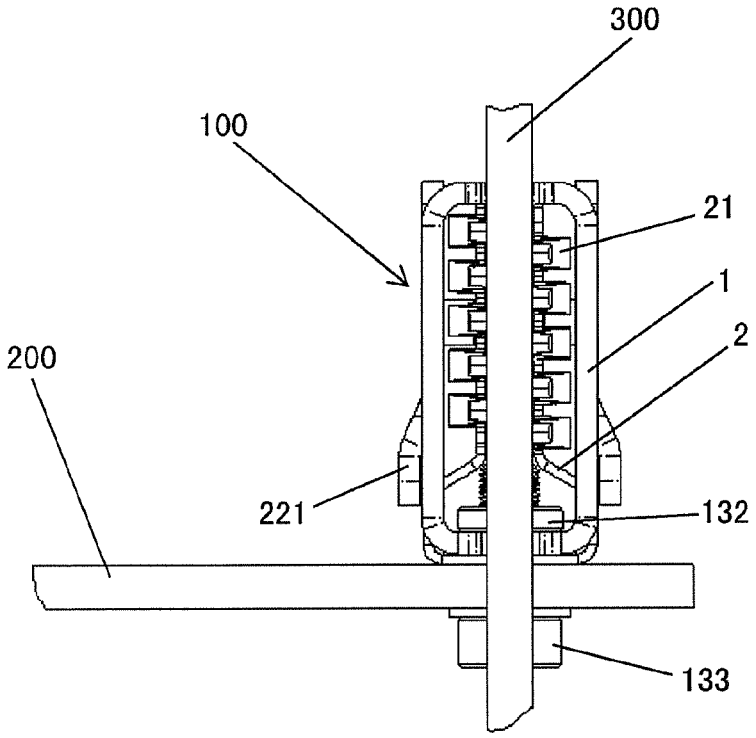
FIG. 7 is a front perspective view of the connector shown in FIG. 6.

The connector 100 further comprises a securing device 130 configured to securely connect the insertion member 13 and the bottom wall 201 of the frame 20 onto a mounting plate 200 (referring to FIGS. 6 and 7). The securing device 130 is positioned inside the housing 1.

Because the securing device 130 is positioned inside the housing 1 of the connector 100, there is no need to provide an additional space on the mounting plate 200 for the securing device 130. As a result, the mounting space on the mounting plate 200 can be saved.

As shown in FIGS. 1-4, according to an embodiment, the securing device 130 includes a first hole 131 formed in the insertion member 13, a screw nut 132 integrally formed on the insertion member 13 at the first hole 131, and a second hole 231 formed in the bottom wall 201 of the frame 20 of the contact 2. When the contact 2 is inserted into the receiving space of the housing 1, the first hole 131 aligns with the second hole 231. As a result, as shown in FIG. 7, a screw bolt 133 can pass through a mounting hole (not shown) on a mounting plate 200, the second hole 231 and the first hole 131 in this order and be secured on the screw nut 132, so that the connector 100 is securely connected to the mounting plate 200.

According the above embodiment, since the screw nut 132 is preset on the connector 100, when the connector 100 is mounted to the mounting plate 200, it is not necessary to mount the screw nut 132 on site. Thus, the connector 100 can be mounted conveniently and the mounting time can be reduced.

According to an embodiment of the invention, the screw nut 132 is a self-locking nut which is pressed and connected integrally on the inner surface of the insertion member 13 of the housing 1 during the process of manufacturing the connector 100. Therefore, the screw nut 132 is securely connected to the insertion member 13 and it is not necessary to pierce a hole in the insertion member 13 while the connector 100 is mounted, thus, it is not necessary to pierce a hole in the thinner insertion member 13.

As shown in FIGS. 1-4, according to an embodiment of the invention, the first hole 131, the second hole 231 and the screw nut 132 are positioned along a longitudinal central line L of the bottom wall 11 of the housing 1. Thus, when the connector 100 is secured to the mounting plate 200, as shown in FIGS. 6 and 7, by the screw nut 132, the connector 100 can be securely mounted to the mounting plate 200 as compared with the case where a fastener nut is positioned in other places.

In the embodiment shown, the connector 100 includes two first holes 131, two second holes 231 and two screw nuts 132, respectively. With this configuration, it is easy to mount the contact 2 on the central line of the bottom wall 11 of the housing 1. However, it should note that the numbers of the first holes 131, the second holes 231 and the screw nuts 132 are not limited to what is shown. Rather, one skilled in the art should appreciate that other design configurations are possible.

As shown in FIG. 2, each side wall 12 include a first side wall section 12*a* connected with the bottom wall 11 and a second side wall section 12*b* that is separated from the bottom wall 11 and positioned to correspond with the insertion member 13. A vertical slit 12*c* is formed between the first side wall section 12*a* and the second side wall section 12*b*.

As shown in FIGS. 1-4, a lower portion 20*b* of each of the second side wall sections 12*b* of the housing 1 flares outward so that the contact 2 can be easily inserted into the housing 1 and will not shake in a left and right direction. As a result, the first side wall section 12*a* serves as a stopping and positioning member for stopping further movement of the frame 20 of the contact 2 when the contact 2 is inserted.

Figure 3:
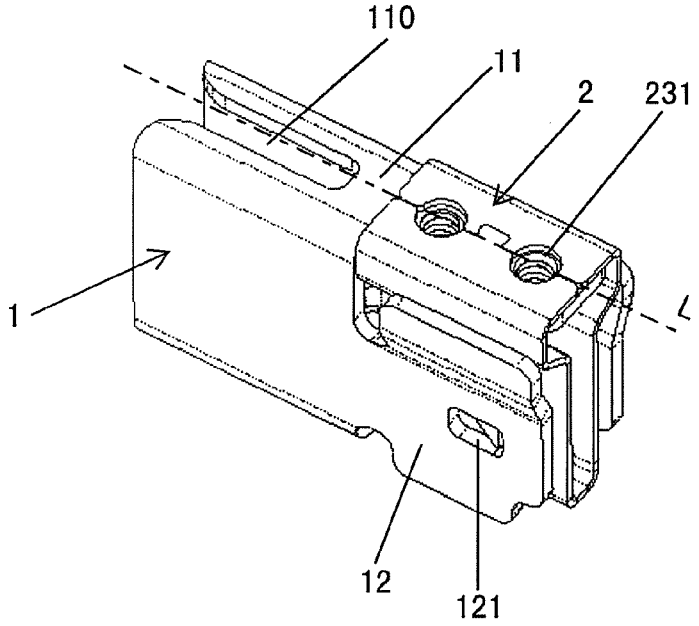
FIG. 3 is a bottom perspective view of the connector shown in FIG. 1.

As shown in FIGS. 1 and 3, when the contact 2 is inserted into the receiving space of the housing 1, the terminal section 21 of the contact 2 is positioned between the first side wall sections 12*a* of the housing 1, and the frame 20 of the contact 2 is positioned between the second side wall sections 12*b* of the housing 1. For this purpose, the connector 100 is manufactured so that a length of the second side wall section 12*b* or the insertion member 13 is approximately equal to the length of the frame 20, and a length of the first side wall section 12*a* of the housing 1 is approximately equal to a length of the terminal section 21 of the contact 2.

As is clearly shown in FIG. 2, each side wall 12 includes a first catch 121, while each side wall 202 includes a second catch 221 that corresponds with the first catch 121. As shown in FIGS. 1 and 3, the first catch 121 engages with the second catch 221 when the contact 2 is inserted in the receiving space of the housing 1. Specifically, according to this embodiment, the first catch 121 is a rectangular opening formed in each side wall 12 of the housing 1 at the second side wall section 12*b*, and the second catch 221 is an elastic projection extending outward from each side wall 202. The elastic projection may be formed by cutting a portion of each side wall 202 of the frame 20 and bending the cut portion.

When the contact 2 is inserted into the receiving space of the housing 1, the elastic projections on the frame 20 make contact with inner surfaces of the side walls 12 of the housing 1 so that the contact 2 can be securely inserted. As the contact 2 is inserted continuously, the elastic projections on the frame 20 enter the respective openings in the side walls 12 of the housing 1. Therefore, the elastic projections may assist to position and secure the contact 2 and the housing 1. The elastic projection may be positioned slantwise in a direction opposite to a direction for inserting the contact 2 into the housing 1. In this way, once the elastic projections enter the respective openings in the side walls 12 of the housing 1, the elastic projections can prevent the contact 2 from removal with from the housing 1 in an opposite direction.

Besides the first catch 121 and the second catch 221 in the above forms, a person skilled in the art can conceive of engaging devices in other forms, such as other known projections and a recesses, or other known mechanically movement resisting or arresting designs.

As is clearly shown in FIGS. 3 and 4, a U-shaped cutout 110 is formed at an end of the bottom wall 11 of the housing 1 opposite to the insertion member 13 for guiding and inserting a bus bar 300 (as shown in FIGS. 6 and 7). Further, the bottom of the U-shaped cutout 110 is used as a stopping and positioning part when the bus bar 300 is inserted. Preferably, the two sides of the opening part of the U-shaped cutout 110 are chamfered so as to guide and insert the bus bar 300 better.

Each of top ends of the first side wall sections 12*a* are bent inward, in the shown embodiment, in order to form an elongated opening 111 aligning with the U-shaped cutout 110 to guide and insert the bus bar 300.

As shown in FIG. 2, the frame 20 includes a narrow upper portion 20*a* and a wide lower portion 20*b* such that the upper portion 20*a* is positioned with respect to a substantial center of the lower portion 20*b*. Accordingly, the frame 20 has a cross section of a generally "ㅓ" or t-shape. The terminal section 21 extends from a front end of the upper portion 20*a*. The lower portion 20*b* is adapted to fit over the insertion member 13 of the housing 1. The lower portion 20*b* has a width approximately equal to that of the housing 1.

Figure 5:
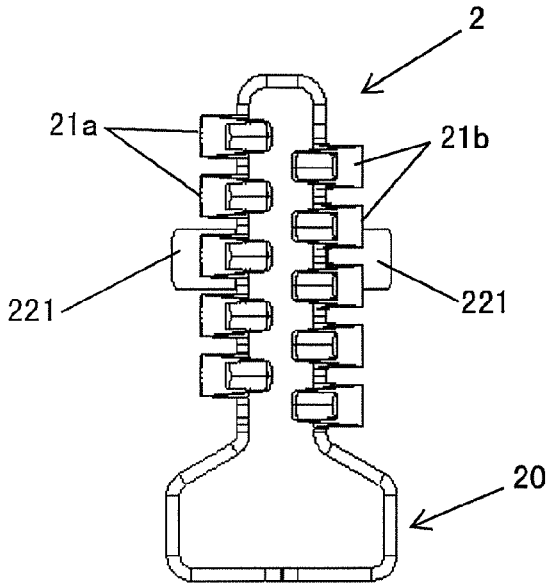
FIG. 5 is a front view of a conductive contacting member of the connector shown in FIG. 1.

As shown in FIGS. 2 and 5, the terminal section 21 includes two rows of terminals extending from the two side walls 202 of the frame 20 along the upper portion 20*a* thereof. The first row of terminals consists of a plurality of first terminals 21*a*. The second row of terminals consists of a plurality of second terminals 21*b*. Each terminal 21*a*, 21*b* is of an elongated bar shape and is bent into a generally S-shape in the embodiment shown. Alternatively, each terminal may have other shapes which are adapted to facilitate connection with an electric bus bar 300. In use, the bus bar 300 shown in FIG. 7 is inserted between the two rows of terminals from a front end thereof and is elastically clamped between the two rows of the terminals.

Further, as shown in FIG. 5, the first terminals 21*a* and the second terminals 21*b* are interleaved with each other between the two rows of terminals. By this arrangement of the terminals, the connector 100 can be ensured to have a low contact resistance.

The housing 1 and the contact 2 of the connector 100 according to an embodiment of the invention can be separately manufactured, and then are assembled together in the way as described above. The housing 1 and the contact 2 each can be manufactured from a single plate of metal by normal cutting, punching, molding or other processes.

As shown in FIGS. 6 and 7, a connector 100 according to the invention is secured on the mounting plate 200 by the following steps. First, the connector 100 is positioned on a mounting surface of the mounting plate 200 with a mounting hole formed in advance there through. The bottom wall 201 is in contact with the mounting surface of the mounting plate 200 and the second hole 231 in the bottom wall 201 of the frame 20 and the first hole 131 in the insertion member 13 of the housing 1 align with the mounting hole in the mounting plate 200. Next, a screw bolt 133 is inserted through the mounting hole of the mounting plate 200 from a bottom surface of the mounting plate 200 opposite to the mounting surface, and causing the screw bolt 133 to engage the screw nut 132 at the first hole 131 so that the connector 100 is secured on the mounting plate 200. At this time, the front portion of the housing 1 is projected beyond the front edge of the mounting plate 200 so as to facilitate the inserting of the electric bus bar 300. Then the bus bar 300 is inserted between the two rows of terminals 21*a* and 21*b* of the contact 2 from the front side of the housing 1 through the U-shaped cutout 110 and the top elongated opening 111 of the contact receiving housing 1, and thus the connection and mounting of the connector 100 is finished. In this state, when a power is applied, the power can be transmitted to the mounting plate 200 from the bus bar 300 through the contact 2 of the connector 100.

Although several exemplary embodiments have been shown and described, it would be appreciated by those skilled in the art that various changes or modifications may be made in these embodiments without departing from the principles and spirit of the disclosure, the scope of which is defined in the claims and their equivalents. It should note that the wording "comprising" or "including" does not exclude other elements or steps and the wording "a" or "an" does not exclude a plural number of an element. The reference numerals appeared in the claims would not be appreciated to limit the scope of the invention.

What is claimed is:

1. An electrical connector comprising:

a contact having a frame and a terminal section extending from a front end of the frame;

a contact receiving housing having a bottom wall and a pair of side walls extending from opposite sides of the bottom wall to define a contact receiving space;

an insertion member extending from an end of the bottom wall of the contact receiving housing and positioned between the pair of side walls, the insertion member abutting an inner surface of a bottom wall of the frame; and a securing device positioned inside the contact receiving housing and the contact for securing the contact and the contact receiving housing in a fixed position.

2. The electrical connector according to claim 1, wherein the securing device includes a fastener positioned through a first hole extending through the insertion member and a second hole extending through the frame.

3. The electrical connector according to claim 2, wherein the fastener is a screw bolt and a screw nut.

4. The electrical connector according to claim 3, wherein the screw nut is a self-locking nut.

5. The electrical connector according to claim 2, wherein the first hole and the second hole correspond with each and are positioned along a longitudinal central line (L) of the bottom wall of the contact receiving housing.

6. The electrical connector according to claim 1, wherein the terminal section includes two rows of terminals consisting of a plurality of first terminals and a plurality of second terminals interleaved with each other.

7. The electrical connector according to claim 6, wherein the two rows of terminals extended from a pair of frame side walls.

8. The electrical connector according to claim 7, wherein each terminal of the two rows of terminals is an elastic terminal having an S-shape.

9. The electrical connector according to claim 1, wherein one of the pair of side walls includes a first catch.

10. The electrical connector according to claim 9, wherein the frame includes a second catch corresponding to the first catch.

11. The electrical connector according to claim 10, wherein the first catch includes an opening formed in the one of the pair of side walls.

12. The electrical connector according to claim 11, wherein the second catch includes an elastic projection extending from a frame side wall.

13. The electrical connector according to claim 1, wherein each side wall of the pair of side walls includes a first side wall section connected with the bottom wall of the contact receiving housing and a second side wall section that is separated from the bottom wall of the contact receiving housing and positioned to correspond with the insertion member.

14. The electrical connector according to claim 13, further comprising a vertical slit formed between the first side wall section and the second side wall section.

15. The electrical connector according to claim 14, wherein a lower portion of second side wall section flares outward to accommodate the contact.

16. The electrical connector according to claim 15, wherein the first side wall section serves as a stopping and positioning member to deter movement of the frame when the contact is inserted into the contact receiving space.

17. The electrical connector according to claim 14, wherein the terminal section is positioned between a pair of first side wall sections and the frame is positioned between a pair of second side wall sections when the contact is inserted into the receiving space of the housing.

18. The electrical connector according to claim 17, wherein the frame includes a wide lower portion and an upper portion positioned above and about a center of the wide lower portion.

19. The electrical connector according to claim 1, wherein the contact receiving housing includes a U-shaped cutout formed at the end of the bottom wall of the contact receiving housing and positioned opposite to the insertion member.

20. An electrical connector comprising:

a contact having a frame and a terminal section extending from a front end of the frame;

a contact receiving housing having a bottom wall and a pair of side walls extending from opposite sides of the bottom wall to define a contact receiving space;

an insertion member extending from an end of the bottom wall and positioned between the pair of side walls, the insertion member corresponding with an inner surface of a bottom wall of the frame; and a securing device positioned inside the contact receiving housing and the contact for securing the contact and the contact receiving housing in a fixed position, the securing device including a fastener positioned through a first hole extending through the insertion member and a second hole extending through the frame, the first hole and the second hole correspond with each other and are positioned along a longitudinal central line of the bottom wall.

21. An electrical connector comprising:

a contact having a frame and a terminal section extending from a front end of the frame;

a contact receiving housing having a bottom wall and a pair of side walls extending from opposite sides of the bottom wall to define a contact receiving space, each side wall of the pair of side walls includes a first side wall section connected with the bottom wall and a second side wall section that is separated from the bottom wall, a vertical slit formed between the first side wall section and the second side wall section;

an insertion member extending from an end of the bottom wall and positioned between the pair of side walls, the insertion member corresponding with an inner surface of the bottom wall and each second side wall section; and a securing device positioned inside the contact receiving housing and the contact for securing the contact and the contact receiving housing in a fixed position.

22. The electrical connector according to claim 21, wherein a lower portion of each second side wall section flares outward to accommodate the contact.

23. The electrical connector according to claim 22, wherein the first side wall section serves as a stopping and positioning member to deter movement of the frame when the contact is inserted into the contact receiving space.

24. The electrical connector according to claim 21, wherein the terminal section is positioned between a pair of first side wall sections and the frame is positioned between a pair of second side wall sections when the contact is inserted into the receiving space of the housing.

25. The electrical connector according to claim 24, wherein the frame includes a wide lower portion and an upper portion positioned above and about a center of the wide lower portion.

* * * * *